US010440457B2

(12) United States Patent
Yamaguchi

(10) Patent No.: US 10,440,457 B2
(45) Date of Patent: Oct. 8, 2019

(54) ELECTRONIC DEVICE

(71) Applicant: FUJITSU LIMITED, Kawasaki-shi, Kanagawa (JP)

(72) Inventor: Atsushi Yamaguchi, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 16 days.

(21) Appl. No.: 15/874,941

(22) Filed: Jan. 19, 2018

(65) Prior Publication Data

US 2018/0227655 A1 Aug. 9, 2018

(30) Foreign Application Priority Data

Feb. 3, 2017 (JP) ..... 2017-018921

(51) Int. Cl.

| | |
|---|---|
| ***H04R 25/00*** | (2006.01) |
| ***H04R 1/08*** | (2006.01) |
| *H04R 1/44* | (2006.01) |
| *H04R 1/28* | (2006.01) |

(52) U.S. Cl.

CPC ..... *H04R 1/083* (2013.01); *H04R 1/2853* (2013.01); *H04R 1/44* (2013.01); *H04R 2410/07* (2013.01)

(58) Field of Classification Search

CPC ..... H04R 1/083; H04R 1/2853; H04R 1/44; H04R 2410/07

USPC ..... 381/338

See application file for complete search history.

(56) References Cited

U.S. PATENT DOCUMENTS

| | | | | |
|---|---|---|---|---|
| 5,226,076 | A * | 7/1993 | Baumhauer, Jr. | H04M 1/19 379/419 |
| 5,703,957 | A * | 12/1997 | McAteer | H04M 1/03 381/355 |
| 5,878,147 | A * | 3/1999 | Killion | H04R 1/406 381/313 |
| 2013/0241045 | A1* | 9/2013 | Goida | B81B 7/0061 257/704 |
| 2017/0137282 | A1* | 5/2017 | Sooriakumar | B81B 7/0061 |

FOREIGN PATENT DOCUMENTS

| | | |
|---|---|---|
| JP | 8-322096 | 12/1996 |
| JP | 2009-212844 | 9/2009 |

* cited by examiner

*Primary Examiner* — Phylesha Dabney
(74) *Attorney, Agent, or Firm* — Fujitsu Patent Center

(57) ABSTRACT

An electronic device includes a housing that has a sound hole formed in an outer surface of the housing, a sound collection member that is disposed in the housing, a sound path that extends from the sound hole to the sound collection member, and a waterproof member that is disposed in the sound path and that reduces a possibility of water reaching the sound collection member via the sound hole, wherein the sound path includes a first path that has a first end coupled to the sound hole and that bends more than once from the first end to a second end of the first path, and a second path that is positioned closer to the sound collection member than the first path is and to which the waterproof member is affixed, the second path extending while having a cross-sectional shape corresponding to a shape of the waterproof member.

7 Claims, 7 Drawing Sheets

ELECTRONIC DEVICE

CROSS-REFERENCE TO RELATED APPLICATION

This application is based upon and claims the benefit of priority of the prior Japanese Patent Application No. 2017-18921, filed on Feb. 3, 2017, the entire contents of which are incorporated herein by reference.

FIELD

The embodiments discussed herein are related to an electronic device.

BACKGROUND

There is known a technology for reducing noise due to wind noise by forming a sound path extending to a sound collection member such that the sound path does not have a linear shape.

However, in a technology of the related art such as that described above, it is difficult to obtain, at the position of a sound collection member, acoustic characteristics with which significant resonance will not occur in up to a high voice frequency band. In recent years, the trend has been toward faster transmission speed in telecommunications and also toward wider bandwidth of voice transmission as a telephone function. In addition, in recent years, a new high-quality audio codec (for example, an enhanced voice services (EVS) codec technology) has been developed by using high-speed transmission such as long term evolution (LTE), and this has enabled sound transmission within a voice frequency band in the range of 50 Hz to 14 kHz, which is a high frequency.

The followings are reference documents:

[Document 1] Japanese Laid-open Patent Publication No. 2009-212844; and

[Document 2] Japanese Laid-open Patent Publication No. 08-322096.

SUMMARY

According to an aspect of the invention, an electronic device includes a housing that has a sound hole formed in an outer surface of the housing, a sound collection member that is disposed in the housing, a sound path that extends from the sound hole to the sound collection member, and a waterproof member that is disposed in the sound path and that reduces a possibility of water reaching the sound collection member via the sound hole, wherein the sound path includes a first path that has a first end coupled to the sound hole and that bends more than once from the first end to a second end of the first path, and a second path that is positioned closer to the sound collection member than the first path is and to which the waterproof member is affixed, the second path extending while having a cross-sectional shape corresponding to a shape of the waterproof member.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Embodiments will be described in detail below with reference to the accompanying drawings.

Figure 1:
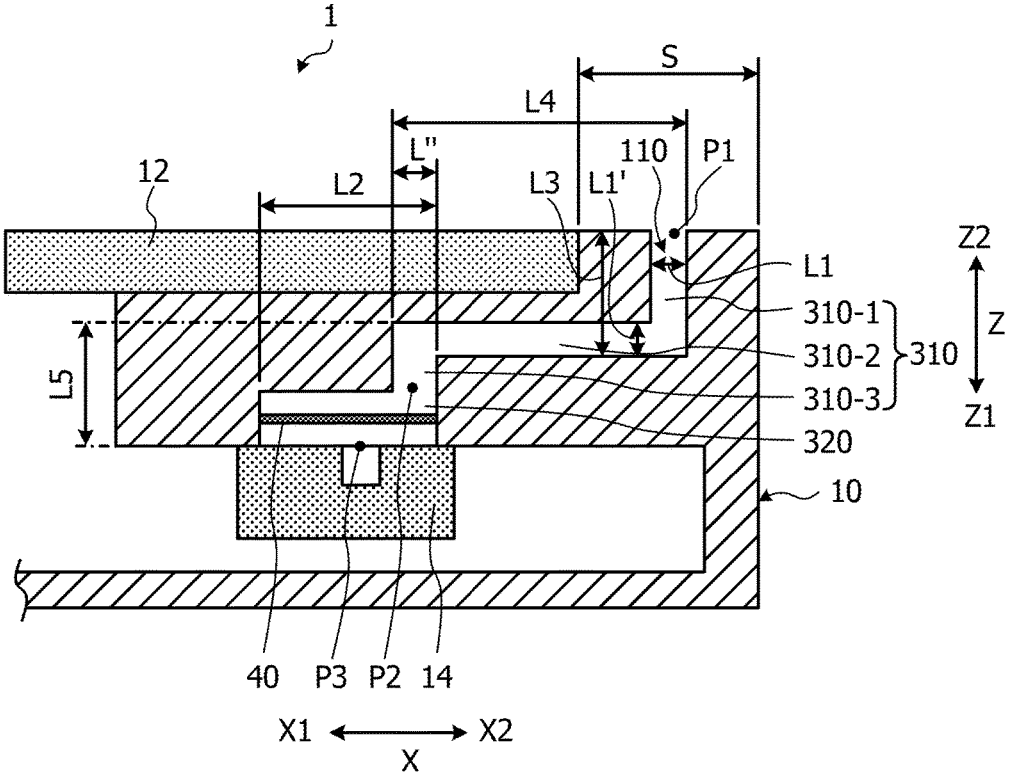
FIG. 1 is a schematic sectional view illustrating a sound path structure of an electronic device according to a first embodiment.

FIG. 1 is a schematic sectional view illustrating an electronic device 1 according to a first embodiment. In FIG. 1, an X direction and a Z direction are defined. The Z direction corresponds to the thickness direction of the electronic device 1 and a direction perpendicular to a flat surface of a display unit 12. The X direction is a direction perpendicular to the Z direction and is parallel to the lateral direction of the electronic device 1. However, the X direction may be parallel not to the lateral direction of the electronic device 1, but to the longitudinal direction of the electronic device 1.

The electronic device 1 is a terminal having a communication function and is, for example, a smartphone, a tablet terminal device, a portable game device, or the like.

The electronic device 1 includes a housing 10, the display unit 12, a microphone 14 (an example of a sound collection member), a sound path structure 30, and a waterproof membrane 40 (an example of a waterproof member).

The housing 10 may be formed of a plurality of housing members. A substrate and electronic components (including the microphone 14), which are not illustrated, are disposed in the housing 10. The housing 10 has a sound hole 110 formed in an outer surface of the housing 10. The sound hole 110 is preferably formed in an outer surface of the housing 10, the outer surface being located on the side on which the display unit 12 is present. This is because, in the case where the sound hole 110 is formed in the outer surface of the housing 10 on the side on which the display unit 12 is present, the voice recognition rate and the efficiency of voice transmission when a user is facing a screen are increased. Thus, in the example illustrated in FIG. 1, the housing 10 has a frame region S in the outer surface thereof on the side on which the display unit 12 is present, and the sound hole 110 is formed in the frame region S. As illustrated in FIG. 1, the frame region S extends along the outer periphery of the display unit 12 and corresponds to a region extending from the outer peripheral edge of the display unit 12 to the outer peripheral edge of the electronic device 1.

The display unit 12 is formed of, for example, a liquid crystal panel, an organic electroluminescence (EL) panel, or the like. The display unit 12 may integrally include a touch panel. The display unit 12 forms a surface approximately parallel to the outer surface of the housing 10.

The microphone 14 generates electrical signals (voice signals) corresponding to sound and voice that are transmitted thereto via the sound path structure 30. For example, a condenser microphone using a diaphragm may be used as the microphone 14.

The sound path structure 30 is formed of, for example, the housing 10. However, the housing 10 and another member may cooperate with each other in forming the sound path structure 30.

The sound path structure 30 includes a first sound path 310 and a second sound path 320.

The first sound path 310 extends from a position P1, which is the position of the sound hole 110 formed in the outer surface of the housing 10, to an inner position P2 in the housing 10 by bending more than once. In the example illustrated in FIG. 1, the first sound path 310 extends by bending twice. More specifically, the first sound path 310 includes a portion 310-1 extending from the sound hole 110 in the Z direction toward a Z1 side, a portion 310-2 extending from the portion 310-1 in the X direction toward an X1 side, and a portion 310-3 extending from the portion 310-2 in the Z direction toward the Z1 side. The first sound path 310 bends between the portion 310-1 and the portion 310-2 and between the portion 310-2 and the portion 310-3. As illustrated in FIG. 1, it is preferable that each of the bend angles of the first sound path 310 be 90 degrees. As a result, in the first sound path 310, the maximum length of straight paths in any possible direction may be effectively reduced. The longer the maximum length of the straight paths in the first sound path 310 in any possible direction, the lower the resonant frequency. Note that the bent portions may be formed in such a manner as to have an arc shape, which is desirable from the standpoint of manufacturing.

Although the cross-sectional shape (the cross-sectional shape when viewed in a direction in which the first sound path 310 extends) of the first sound path 310 may be any shape, it is preferable that the cross-sectional shape of the first sound path 310 be a quadrangular shape (a square shape or a rectangular shape). In the case where the cross-sectional shape of the first sound path 310 is a quadrangular shape, dimensional control may be easily performed, and the first sound path 310 may be the most easily manufactured. Each dimension of the cross-sectional shape of the first sound path 310 is set to 5 mm or less. For example, when the cross-sectional shape of the first sound path 310 has a length a [mm] and a width b [mm], each of the dimensions a and b is set to 5 mm or less. For example, the dimensions a and b are 0.8 and 1.0, respectively. FIG. 1 illustrates dimensions L1, L1', L1" (dimensions each of which corresponds to one of the dimensions a and b) that are related to the cross-sectional shape, and each of these dimensions is set to 5 mm or less. It is preferable that the dimensions L1, L1', L1" be lengths that are approximately equal to one another. In other words, the first sound path 310 extends with a uniform cross section from the position P1 to the inner position P2 in the housing 10 by bending more than once. However, in a modification (also see FIG. 5), the first sound path 310 may have a portion having a different cross-sectional shape. Note that, in the case where the cross-sectional shape of the first sound path 310 is an elliptical shape, the dimension of the first sound path 310 in the long axis direction thereof is set to 5 mm or less. In the case where the cross-sectional shape of the first sound path 310 is a circular shape, the diameter thereof is set to 5 mm or less. The definition of the term "5 mm" will be described later.

The second sound path 320 is connected to the first sound path 310 at the inner position P2. The second sound path 320 is a portion that forms a space in which the waterproof membrane 40 is to be disposed. The second sound path 320 extends in the Z direction. A first end (an end on a Z2 side) of the second sound path 320 is connected to the first sound path 310 at the inner position P2, and a second end (an end on the Z1 side) of the second sound path 320 extends to a position P3, which is the position of the microphone 14. Although the second sound path 320 linearly extends without bending, the second sound path 320 may bend in a modification.

As will be described later, the cross-sectional shape (the cross-sectional shape when viewed in the Z direction) of the second sound path 320 corresponds to the shape of the waterproof membrane 40 and is, for example, a quadrangular shape (a square shape or a rectangular shape). In addition, the second sound path 320 extends with a uniform cross section in the Z direction. Thus, the second sound path 320 is formed in a rectangular parallelepiped shape or a cubic shape.

Each dimension of the cross-sectional shape of the second sound path 320 is set to 5 mm or less. For example, when the second sound path 320 is formed in a rectangular parallelepiped shape having a length c [mm] and a width d [mm], each of the dimensions c and d is set to 5 mm or less. FIG. 1 illustrates a dimension L2 (a dimension that corresponds to one of the dimensions c and d) that is related to the cross-sectional shape, and the dimension L2 is set to 5 mm or less. However, as will be described later, the minimum dimension of the cross-sectional shape of the second sound path 320 is greater than that of the cross-sectional shape of the first sound path 310 due to the fact that the waterproof membrane 40 is disposed in the second sound path 320. For example, the dimension L2 is significantly greater than each of the above-mentioned dimensions (for example, the dimensions L1, L1', L1") related to the cross-sectional shape of the first sound path 310. The definition of the term "5 mm" will be described later.

The sound path structure 30 is fabricated so as not to have a straight path having a length of greater than 5 mm in any direction. More specifically, as described above, each of the dimensions of the cross-sectional shapes of the first sound path 310 and the second sound path 320 is set to 5 mm or less. In addition, the lengths of the portions 310-1 and 310-2 of the first sound path 310 are each set to 5 mm or less. FIG. 1 illustrates a length L3 of the portion 310-1 and a length L4 of the portion 310-2, and the lengths L3 and L4 are each set to 5 mm or less. In addition, the length (L5 in FIG. 1) of the longest straight path that is formed of the portion 310-3 of the first sound path 310 and the second sound path 320 is set to 5 mm or less. The sound path structure 30 is fabricated in the manner described above so as not to have a straight path having a length of greater than 5 mm in any direction. Note that the total length (≈L3+L4+L5) from the sound hole 110 to the microphone 14 is significantly greater than 5 mm.

The waterproof membrane 40 is in the form of a sheet and has a waterproof function. The waterproof membrane 40 may be formed by using, for example, a product known under the trade name of "GORE (Registered Trademark) Acoustic Vent GAW331" or the like. The waterproof membrane 40 is affixed to the second sound path 320 of the sound path structure 30. As a result, water that flows along the sound path structure 30 toward the microphone 14 is interrupted by the waterproof membrane 40, so that the microphone 14 may be protected against the water. For example, the waterproof membrane 40 has a size of about 3 mm×about 3 mm and is significantly greater than the cross-sectional shape of the first sound path 310. The dimensions of the cross-sectional shape (the cross-sectional shape when viewed in the Z direction) of the second sound path 320 are set in accordance with the size of the waterproof membrane 40 in such a manner as to enable the waterproof membrane 40 to be affixed to the second sound path 320. Thus, each of the dimensions of the cross-sectional shape (the cross-sectional shape when viewed in the Z direction) of the second sound path 320 is, for example, about 3 mm. In other words, the cross-sectional shape of the second sound path 320 is a shape slightly smaller than the shape of the waterproof membrane 40 due to the fact that the outer peripheral portion of the waterproof membrane 40 is held at the inner periphery of the second sound path 320. This implies that the cross-sectional shape is significantly greater than the cross-sectional shape of the first sound path 310 having a size of, for example, about 0.8 mm×about 1.0 mm.

As described above, the trend in recent years has been toward faster transmission speed in telecommunications and also toward wider bandwidth of voice transmission as a telephone function. In recent years, a new high-quality audio codec has been developed by using high-speed transmission such as LTE, and for example, an EVS codec technology enables sound transmission within a voice frequency band in the range of 50 Hz to 14 kHz, which is a high frequency.

Regarding this, according to the first embodiment, by providing the above-described sound path structure 30, acoustic characteristics with which resonance will not occur at up to 16 kHz may be obtained at the position of the microphone 14 (see the position P3). In other words, acoustic characteristics with which resonance will not occur at any frequency within the voice frequency band in the range of 50 Hz to 14 kHz may be obtained at the position of the microphone 14.

More specifically, acoustic resonance is likely to occur at ¼ wavelength. When a sound speed c is 343.6 m/s (at 20 degrees), the following formula holds true: ¼ wavelength=c/f/4, where f stands for frequency [Hz]. When f is 14, ¼ wavelength is 6.1 mm as expressed by the following formula: ¼ wavelength=343.6 m/s/14 kHz/4=6.1 mm. As other examples, for reference, ¼ wavelength when f is 16, ¼ wavelength when f is 18, and ¼ wavelength when f is 20 are as follows: ¼ wavelength at 16 kHz=5.4 mm, ¼ wavelength at 18 kHz=4.8 mm, and ¼ wavelength at 20 kHz=4.3 mm. The above leads to the fact that a value of less than 5.4 mm is preferable in order not to cause resonance at 16 kHz and that an appropriate value is 5 mm or less considering variations in the sound speed depending on temperature, the accuracy with which a structure is fabricated, and the like. In other words, when the length of the longest straight path in the sound path structure 30 is denoted by Lmax, it is theoretically understood that resonance at 16 kHz will not occur as long as the length Lmax is 5 mm or less. According to the first embodiment, as described above, since the sound path structure 30 is fabricated so as not to have a straight path having a length of greater than 5 mm in any direction, the length Lmax is 5 mm or less, and resonance will not occur at up to 16 kHz. In other words, according to the first embodiment, a microphone structure capable of performing acoustic sensing without causing a large resonance to occur in up to the frequency range of human hearing including 16 kHz may be fabricated.

Other advantageous effects according to the first embodiment will now be described with reference to FIG. 2 and FIG. 3 by comparing with comparative examples.

Figure 2:
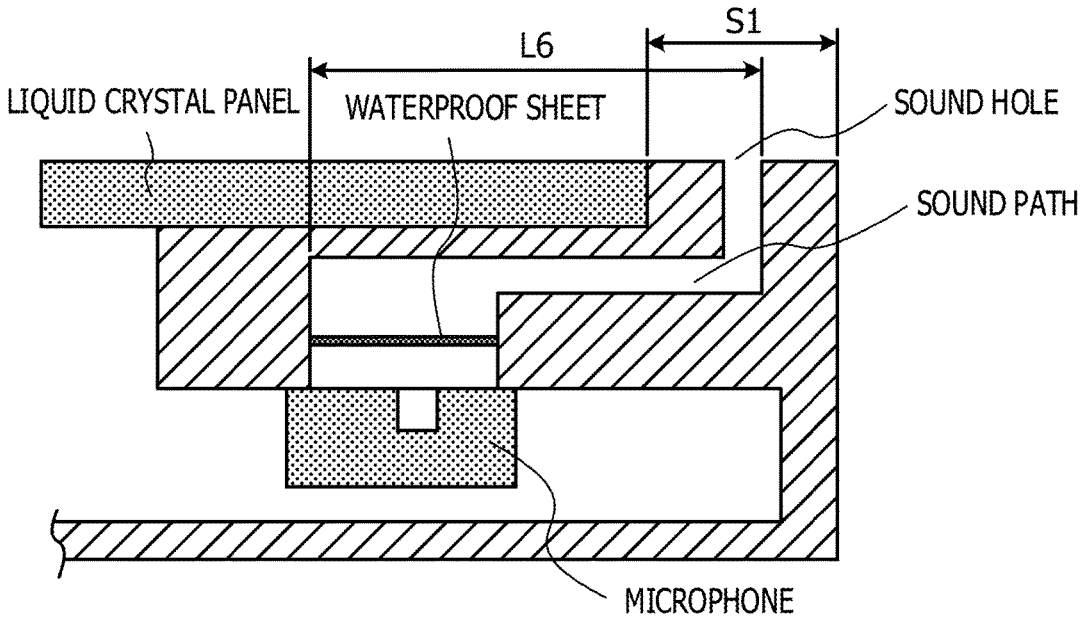
FIG. 2 is a cross-sectional view of an electronic device that has a sound path structure according to a first comparative example.
Figure 3:
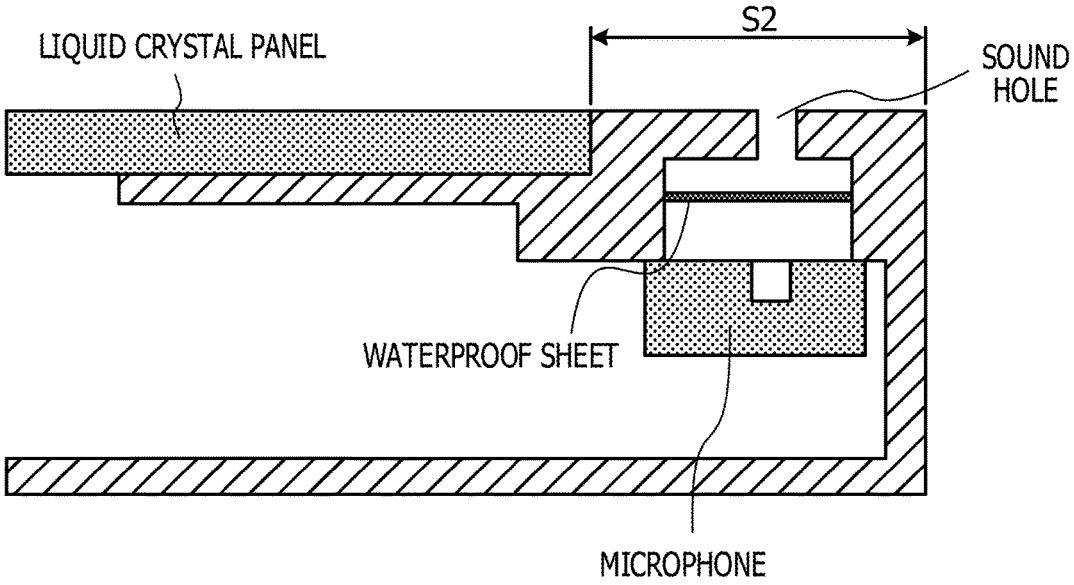
FIG. 3 is a cross-sectional view of an electronic device that has a sound path structure according to a second comparative example.

FIG. 2 is a cross-sectional view of an electronic device that has a sound path structure according to a first comparative example, and FIG. 3 is a cross-sectional view of an electronic device that has a sound path structure according to a second comparative example. A waterproof membrane is provided in each of the first comparative example and the second comparative example so that a waterproof function is realized.

In the comparative example, a dimension L6 is increased by an amount equal to the size of the waterproof membrane, and as a result, the dimension L6 is significantly greater than 5 mm. Thus, in the first comparative example, it is difficult to obtain, at the position of a microphone, acoustic characteristics with which resonance will not occur in up to a high voice frequency band.

In contrast, according to the first embodiment, the first sound path 310 bends more than once so as to form the portion 310-3 as described above, so that the dimension L6 may be reduced to the dimension L4 (in other words, the dimension L6 may be split into the dimension L4 and the dimension L2). As a result, the dimension L4 may be set to 5 mm or less, and the acoustic characteristics with which resonance will not occur in up to a high voice frequency band may be obtained at the position of the microphone 14.

In the second comparative example, the waterproof membrane is disposed directly under a sound hole, and thus, a sound path structure that does not have a straight path having a length of greater than 5 mm in any direction may be fabricated. However, in the second comparative example, a frame region S2 is likely to be increased due to the waterproof membrane disposed directly under the sound hole. In other words, in the second comparative example, the above-mentioned sound path structure may be fabricated, but on the other hand the frame region S2 is likely to be increased by an amount equal to the size of the waterproof membrane. In addition, there is a case where a waterproof packing member (see FIG. 5, which will be described later) is disposed directly under the sound hole, and in practice, it is often difficult to dispose the waterproof membrane directly under the sound hole.

In recent years, the models of smartphones and tablet terminals each having a screen that is wide with respect to its device size have become popular. A screen having a large size provides view ability, but on the other hand there is a tendency to dislike carrying a large screen whose size has become large due to an extra frame. There is a product on the market whose frame has been partially removed by using a curved display.

Regarding this, according to the first embodiment, the size of a frame region S1 may be reduced by bending the first sound path 310 positioned directly under the sound hole 110. As a result, for example, a dimension of the frame region S1 for forming the sound hole 110 may be minimized, and the degree of freedom in design may be increased. In addition, even in the case where a waterproof packing member is disposed directly under the sound hole 110, both reducing the size of the frame region S1 and disposing the waterproof packing member directly under the sound hole 110 may be easily achieved by bending the first sound path 310 positioned directly under the sound hole 110 (see FIG. 5, which will be described later).

According to the first embodiment, the sound path structure 30 bends more than once in a plane including the Z-axis (that is, the sound path structure 30 does not bend in a horizontal plane). Consequently, even in a case where the microphone 14 is disposed at a position far from the outer surface on the side on which the display unit 12 is present (a position spaced apart from the outer surface toward the Z1 side), the sound path structure 30 that does not have a straight path having a length of greater than 5 mm in any direction may be easily fabricated. For example, even in a case where the microphone 14 is disposed at a position spaced apart from the sound hole 110 by 5 mm or more in the Z direction, the sound path structure 30 that does not have a straight path having a length of greater than 5 mm in any direction may be easily fabricated.

Note that, although not illustrated, in a case where a sound hole is formed in a side surface or a rear surface of a housing, both a sound path structure with less acoustic resonance may be fabricated while a frame is made narrow. However, since the sound hole is not located on a display (screen) side, a problem occurs in that, for example, the sensitivity of acoustic sensing in an operating state decreases. Regarding this, according to the first embodiment, since the sound hole 110 is formed in the outer surface of the housing 10 on the side on which the display unit 12 is present, the probability of the occurrence of the above problem may be reduced. However, in a modification, the sound hole 110 may be formed in a side surface or a rear surface of the housing 10. For example, in the case where the sound hole 110 is formed in a side surface of the housing 10, the sound path structure 30 illustrated in FIG. 1 may be fabricated as a structure obtained by rotating the sound path structure 30 by 90 degrees.

Figure 4:
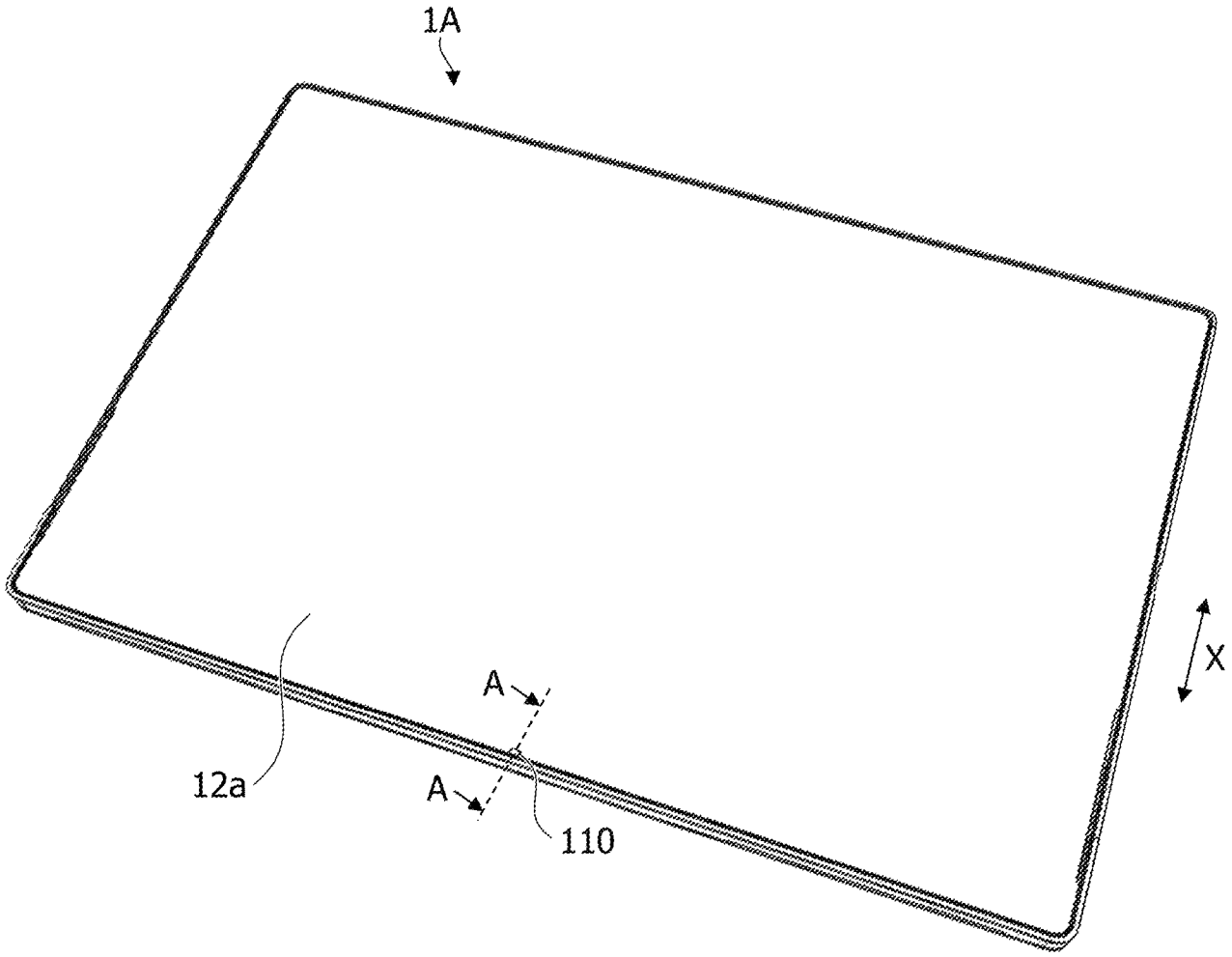
FIG. 4 is a perspective view of an electronic device according to a second embodiment when viewed from a display unit.
Figure 5:
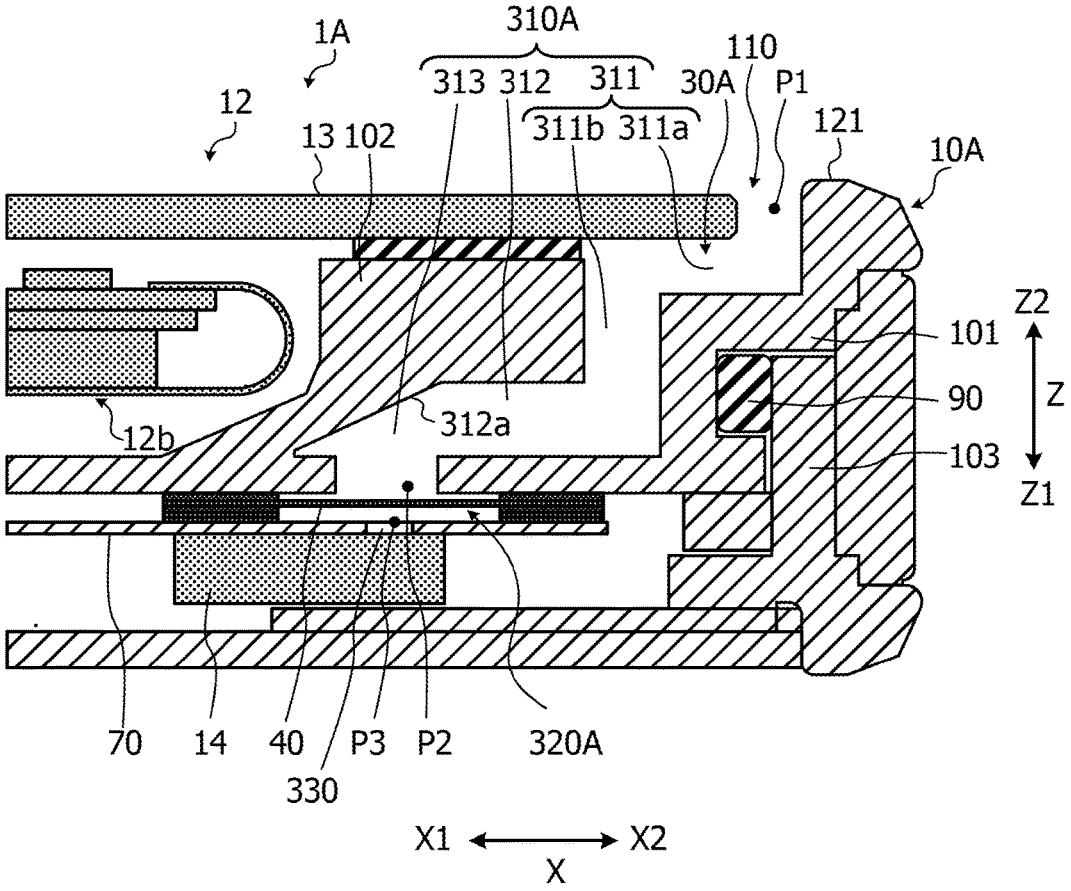
FIG. 5 is a sectional view taken at the position of a sound hole of the electronic device according to the second embodiment.
Figure 6:
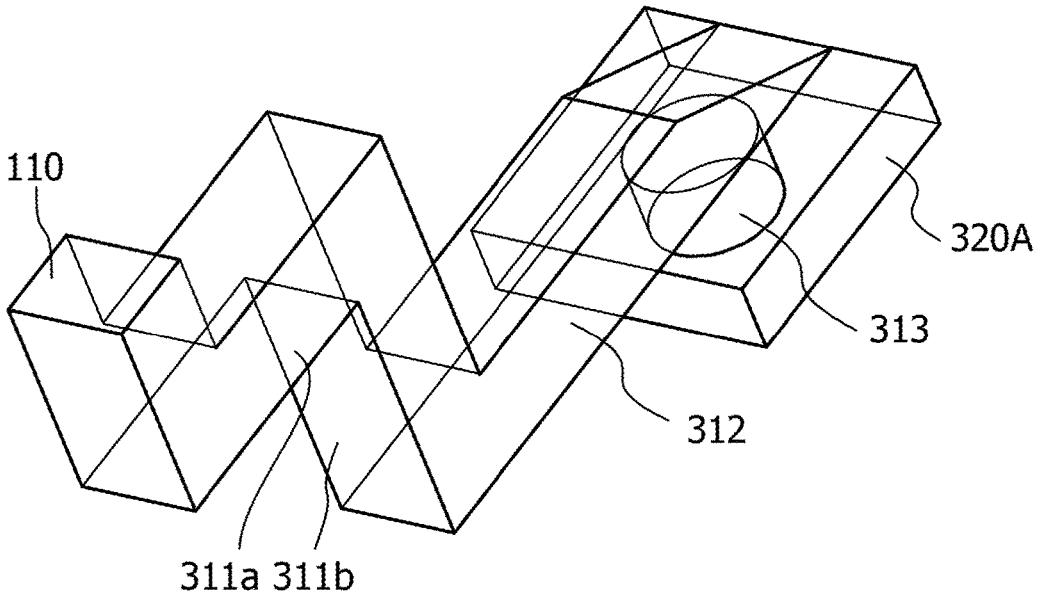
FIG. 6 is a perspective view illustrating only a sound path portion.

As a more specific implementation example, an electronic device 1A according to a second embodiment will now be described with reference to FIG. 4 to FIG. 6. In FIG. 4 to FIG. 6, components that are common to the above-described electronic device 1 are denoted by the same reference signs, and detailed descriptions thereof will be omitted.

FIG. 4 is a perspective view of the electronic device 1A when viewed from the display unit 12. FIG. 5 is a sectional view taken at the position of the sound hole 110 of the electronic device 1A and corresponds to a cross-sectional view taken along line A-A of FIG. 4. FIG. 6 is a perspective view illustrating only a sound path portion of a sound path structure 30A.

The electronic device 1A has the sound hole 110 formed between an edge 121 of an outer surface of a housing 10A, the outer surface being located on the side on which the display unit 12 is present, and a glass plate 13.

The housing 10A is formed of a plurality of housing members including housing members 101, 102, and 103 and the like. A waterproof packing member 90 is disposed between the housing member 101 and the housing member 103. As illustrated in FIG. 5, the packing member 90 is disposed below the sound hole 110.

The sound path structure 30A includes a first sound path 310A, a second sound path 320A, and a third sound path 330.

The first sound path 310A extends from the position P1 of the sound hole 110, which is formed in the outer surface of the housing 10A, to the inner position P2 in the housing 10A by bending more than once. In the example illustrated in FIG. 5, the first sound path 310A includes portions 311 to 313. The portion 311 includes a portion 311*a* extending directly under the sound hole 110 and a portion 311*b* extending from the portion 311*a* in the Z direction toward the Z1 side. The portion 312 extends from the portion 311*b* in the X direction toward the X1 side, and the portion 313 extends from the portion 312 in the Z direction toward the Z1 side. The first sound path 310A bends between the portion 311*a* and the portion 311*b*, between the portion 311*b* and the portion 312, and the portion 312 and the portion 313.

As illustrated in FIG. 5 and FIG. 6, it is preferable that each of the bend angles of the first sound path 310A be 90 degrees. The portion 312 has an inclined surface 312*a* that is formed as a result of an end portion of the portion 312, the end portion being located on the side on which the portion 313 is present and on the Z2 side, being chamfered. In other words, the lengthwise dimension of the quadrangular cross-sectional shape of the end portion of the portion 312, which is located on the side on which the portion 313 is present, when viewed from the direction in which the portion 312 extends gradually decreases toward the X1 side. As a result, for example, a space in which a liquid crystal panel unit 12*b* is to be disposed may be easily ensured.

The second sound path 320A is connected to the first sound path 310A at the inner position P2. The second sound path 320A extends in the Z direction. A first end (an end on the Z2 side) of the second sound path 320A is connected to the first sound path 310A at the inner position P2.

The third sound path 330 extends from the end of the second sound path 320A on the Z2 side to the position of the microphone 14. A hole formed in a substrate 70 forms the third sound path 330. The microphone 14 is disposed on the substrate 70 on the Z1 side.

Note that the substrate 70 extends behind the liquid crystal panel unit 12*b* (on the Z1 side). In addition, a processing device (not illustrated) that processes a voice signal generated by the microphone 14 is mounted on the substrate 70. The processing device may be provided with a recognition engine that performs, for example, voice recognition, environment recognition, or the like.

An outer peripheral portion of the waterproof membrane 40 on the Z2 side is, for example, bonded to the housing member 101 and the housing member 102. In addition, an outer peripheral portion of the waterproof membrane 40 on the Z1 side is brought into contact with the substrate 70 with, for example, a rubber member interposed therebetween.

Similar to the above-described sound path structure 30, the sound path structure 30A is fabricated so as not to have a straight path having a length of greater than 5 mm in any direction. As a result of the sound path structure 30A being fabricated in this manner, resonance will not occur at up to 16 kHz.

Here, in the example illustrated in FIG. 5, since the waterproof packing member 90 is disposed directly under the sound hole 110, it is difficult to dispose the waterproof membrane 40 directly under the sound hole 110, and sound path formation is limited. Regarding this, in the sound path structure 30A, the first sound path 310A that bends substantially three times is formed as described above, so that a structure capable of addressing the above problem while the waterproof packing member 90 is disposed directly under the sound hole 110 may be fabricated.

Figure 7:
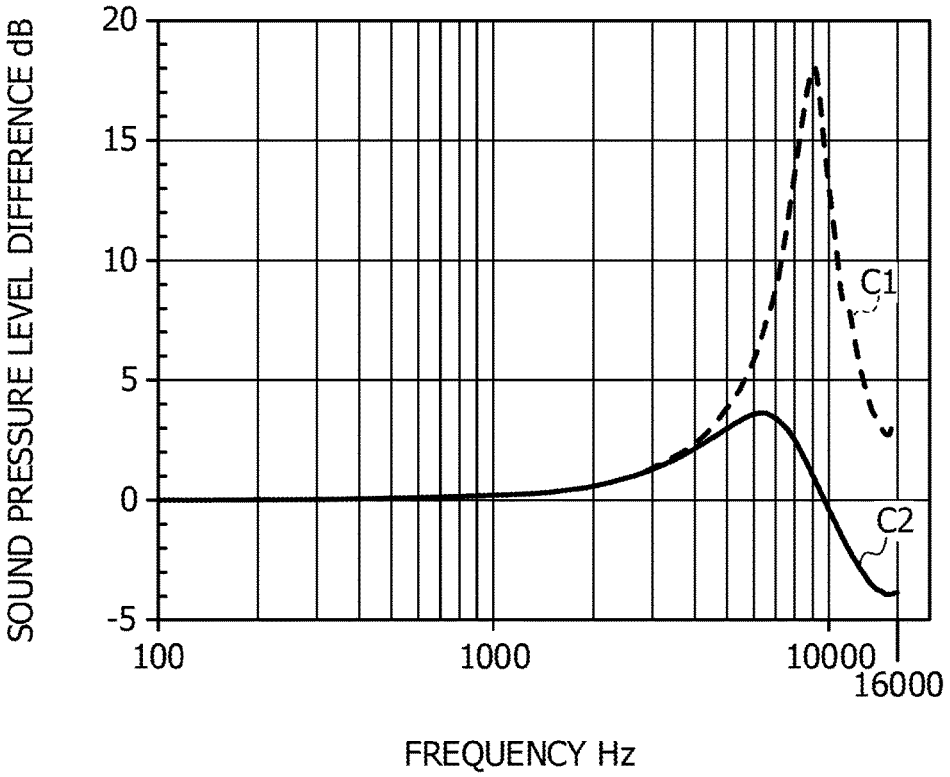
FIG. 7 is a graph illustrating simulation examples of acoustic characteristics.

FIG. 7 illustrates a simulation example of an acoustic characteristic in the second embodiment and a simulation example of an acoustic characteristic in the first comparative example (see FIG. 2). Each of the simulations is performed by reducing a measurement-dependent resonance frequency and in an environment with a sound level of 92 dB at each frequency. The simulation in the second embodiment is performed by using the sound path structure 30A of the electronic device 1A. FIG. 7 is a graph normalized to sound pressure level at a microphone surface. In FIG. 7, the characteristic in the first comparative example is indicated by C1, and the characteristic in the second embodiment is indicated by C2.

As depicted by the characteristic C1 in FIG. 7, in the first comparative example, resonance of about 18 dB occurs at a frequency near 10 kHz. When resonance of about 18 dB occurs, gradations for acoustic expression of 10^(18/10)=63.1 are desirable. Note that the symbol "^" represents exponentiation. In a case where a voice signal is captured by an analog-to-digital (A/D) converter, 2^6=64 holds, and this implies that a data area of about 6 bits is lost due to this resonance. When using a 16-bit digital signal processor (DSP) or a 16-bit A/D converter, only the remaining data area of 10 bits or less is available for voice recognition. In practice, there is sound level difference at each frequency, and thus, only fewer bits are available in voice recognition, which in turn results in a significant deterioration of the recognition accuracy.

In contrast, as depicted by the characteristic C2 in FIG. 7, in the second embodiment, significant resonance does not occur at up to 16 kHz. Note that the wording "significant resonance does not occur" indicates that a characteristic that slightly fluctuates as depicted by the characteristic C2 (for example, a characteristic that fluctuates within a range of less than 5 dB) may be included. The reason why the characteristic C2 is not completely flat and slightly fluctuates is that the characteristic C2 is an acoustic characteristic depending on the entire length of a sound path. As described above, according to the second embodiment, voice recognition, environment recognition, or the like may be performed with a loss of only about 2 to 3 bits. Thus, in the case where the quality that may be recognized in the first comparative example is sufficient, 3 to 4 bits may be assigned to the dynamic range of recognizable sound, and an increase in the dynamic range by 8 to 16 times, that is, 9 to 12 dB may be achieved. In order to perform acoustic transmission while maintaining a clarity of sound, about 12 bits are desirable. Therefore, it is understood that a clear acoustic detection may be performed if data loss is about 4 bits as in the second embodiment.

Although the embodiments have been described in detail above, the present disclosure is not limited to specific embodiments, and various modifications and changes may be made within the scope of the claims. In addition, all or some of the components according to the above-described embodiments may be combined with one another.

For example, in the above-described embodiments, although a reference value is 5 mm because the above-described embodiments are targeted on a structure with which resonance will not occur at up to 16 kHz, the reference value may be a different value. The target may be a structure with which resonance will not occur at up to 14 kHz or a structure with which resonance will not occur at up to 13 kHz or 12 kHz. For example, a value of less than 6.1 mm is preferable in order not to cause resonance at 14 kHz, and an appropriate value is, for example, 5.5 mm or less considering variations in the sound speed depending on temperature, the accuracy with which a structure is fabricated, and the like. In other words, a sound path structure that does not have a straight path having a length of greater than 5.5 mm in any direction may be fabricated in order to fabricate a structure with which resonance will not occur at up to 14 kHz.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An electronic device comprising:

a housing that has a sound hole formed in an outer surface of the housing; a sound collection member that is disposed in the housing;

a sound path that extends from the sound hole to the sound collection member; and a waterproof member that is disposed in the sound path and that reduces a possibility of water reaching the sound collection member via the sound hole, wherein the sound path includes a first path that has a first end coupled to the sound hole and that bends more than once from the first end to a second end of the first path, and a second path that is positioned closer to the sound collection member than the first path is and to which the waterproof member is affixed, the second path extending while having a cross-sectional shape corresponding to a shape of the waterproof member, the outer surface of the housing has a frame region extending along an outer periphery of a display unit, and wherein the sound hole is formed in the frame region.

2. The electronic device according to claim 1, wherein, when viewed in a direction in which the first path extends, a cross-sectional shape of the first path has a lengthwise dimension and a widthwise dimension each of which is not greater than 5 mm.

3. The electronic device according to claim 1, wherein, when viewed in a direction in which the second path extends, the cross-sectional shape of the second path has a lengthwise dimension and a widthwise dimension each of which is not greater than 5 mm.

4. The electronic device according to claim 1, wherein the sound path is formed such that a straight path has a length of not greater than 6.1 mm in any direction.

5. The electronic device according to claim 1, wherein the sound path is formed such that a straight path has a length of not greater than 5 mm in any direction.

6. The electronic device according to claim 1, wherein the second path extends linearly in a thickness direction of the electronic device, and wherein the first path bends more than once in a plane including the thickness direction.

7. The electronic device according to claim 1, wherein the sound path is fabricated of a member that forms the housing.

* * * * *